US007052247B2

(12) United States Patent
Lee

(10) Patent No.: US 7,052,247 B2
(45) Date of Patent: May 30, 2006

(54) SUCTION MUFFLER FOR COMPRESSORS, COMPRESSOR WITH THE SUCTION MUFFLER, AND APPARATUS HAVING REFRIGERANT CIRCULATION CIRCUIT INCLUDING THE COMPRESSOR

(75) Inventor: Sung Tae Lee, Kwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 402 days.

(21) Appl. No.: 10/430,385

(22) Filed: May 6, 2003

(65) Prior Publication Data

US 2004/0179955 A1 Sep. 16, 2004

(30) Foreign Application Priority Data

Mar. 12, 2003 (KR) ..... 2003-15341

(51) Int. Cl.
*F04B 39/00* (2006.01)

(52) U.S. Cl. ..... 417/312; 181/229; 181/274

(58) Field of Classification Search ..... 417/312; 181/229, 274, 403
See application file for complete search history.

(56) References Cited

U.S. PATENT DOCUMENTS 3,166,152 A * 1/1965 Conlin ..... 181/274
3,243,011 A * 3/1966 Hill ..... 181/274
4,162,904 A * 7/1979 Clay et al. ..... 181/274
4,559,686 A * 12/1985 Kessler ..... 29/888.025
5,443,371 A * 8/1995 Calciolari ..... 417/312
6,415,888 B1 * 7/2002 An et al. ..... 181/229

* cited by examiner

*Primary Examiner*—Michael Koczo, Jr.
(74) *Attorney, Agent, or Firm*—Ladas & Parry

(57) ABSTRACT

Disclosed herein are a suction muffler for compressors, a compressor with the suction muffler, and an apparatus having a refrigerant circulation circuit including the compressor. The present invention allows an amount of a refrigerant sucked into a compression chamber to be maximized, and allows suction noise generated during a suction stroke to be minimized. The suction muffler includes a refrigerant channel, and an outer casing. The refrigerant channel communicates at an inlet thereof with a suction pipe which guides a refrigerant to a compressor, and controllably communicates at an outlet thereof with a compression chamber in which the refrigerant is compressed. The outer casing has a structure to convert a flowing motion of the refrigerant into a spiral flowing motion while the refrigerant flows from the suction pipe to the inlet. At least one resonance chamber is formed around an outlet of the refrigerant channel. The compressor having the suction muffler includes at least one insulating space to prevent a heat transfer between the refrigerant inside a refrigerant intake chamber and the refrigerant inside a refrigerant discharge chamber. Further, the compressor is applied to an apparatus having a refrigerant circulation circuit. The present invention increases compression efficiency of the compressor, and considerably reduces suction noise.

11 Claims, 8 Drawing Sheets

SUCTION MUFFLER FOR COMPRESSORS, COMPRESSOR WITH THE SUCTION MUFFLER, AND APPARATUS HAVING REFRIGERANT CIRCULATION CIRCUIT INCLUDING THE COMPRESSOR

CROSS-REFERENCE TO RELATED APPLICATION

This application claims the benefit of Korean Application No. 2003-15341, filed Mar. 12, 2003, in the Korean Intellectual Property Office, the disclosure of which is incorporated herein by reference.

BACKGROUND OF THE INVENTION

1. Field of the Invention

The present invention relates, in general, to a suction muffler for compressors, a compressor with the suction muffler, and an apparatus having a refrigerant circulation circuit including the compressor, more particularly, to a suction muffler which is designed to increase compression efficiency and reduce noise, a compressor with the suction muffler, and an apparatus having a refrigerant circulation circuit including the compressor.

2. Description of the Related Art

As well known to those skilled in the art, a refrigerant circulation circuit includes a compressor, a condenser, an expansion unit, and an evaporator. A refrigerant under low pressure is fed into the compressor to be compressed, thus generating the refrigerant under high pressure. The condenser condenses the refrigerant fed from the compressor, and the expansion unit expands the refrigerant fed from the condenser. The refrigerant fed from the expansion unit is evaporated in the evaporator to absorb heat from air around it. In a brief description of a refrigerant circulation cycle, the compressor is a moving part providing power to circulate the refrigerant, whereas the condenser, the expansion unit, and the evaporator are immobile parts constituting a refrigerant circulation passage.

The compressor includes a compressing unit, a motor unit, a casing, a suction pipe and an exhaust pipe. The compressing unit compresses the refrigerant using power transmitted from the motor unit. The compressing unit and the motor unit are hermetically sealed in the casing. The suction pipe guides the refrigerant from an outside to the casing. The refrigerant is discharged through the exhaust pipe to the outside of the compressor.

In this case, the compressing unit includes a cylinder block having a compression chamber. A piston is provided in the compression chamber to compress the refrigerant. A cylinder head seals the compression chamber, and is partitioned into a refrigerant discharge chamber and a refrigerant intake chamber. The compressing unit also has a valve unit. The valve unit is provided between the cylinder block and the cylinder head so as to control an intake of the refrigerant into the compression chamber and a discharge of the refrigerant from the compression chamber after compressing the refrigerant.

Further, the compressor includes a suction muffler to reduce noise generated while the refrigerant is sucked into the compression chamber. The suction muffler is installed between the compression chamber and the suction pipe.

There are several patent applications related to the suction muffler, including Korea Patent Appln. No. 10-1997-0052555, 10-1999-0055955, 10-2000-0024345, 10-2001-0034226, which have been invented by the same inventor as the present invention.

The strokes of exhausting and sucking the refrigerant in the compressor which constitutes the refrigerant circulation circuit, together with the condenser, the expansion unit, and the evaporator, are as follows. That is, at the exhaust stroke, the refrigerant compressed in the compression chamber sequentially passes through the valve unit, the refrigerant discharge chamber, the exhaust pipe, and the suction pipe. Meanwhile, at the suction stroke, the refrigerant is fed into the compression chamber after sequentially passing through the suction pipe, the suction muffler, the refrigerant intake chamber, and the valve unit.

In this case, since the exhaust stroke and the suction stroke are alternately carried out in the compression chamber, the suction pipe, all of the suction muffler, and the refrigerant intake chamber may be affected by a discharge pressure of the refrigerant generated during the exhaust stroke, but the valve unit prevents the refrigerant from flowing into the compression chamber. Thus, the refrigerant flowing to the suction muffler is dispersed around the suction muffler, so density of the refrigerant becomes smaller. When the exhaust stroke switches to the suction stroke in such a state, the refrigerant sucked into the compression chamber has small density relative to a volume thereof, so compression efficiency is poor.

Further, the cylinder head is made of a metal having high heat conductivity, such as aluminum, so a heat transfer may occur between the high-temperature refrigerant inside the refrigerant discharge chamber and the low-temperature refrigerant inside the refrigerant intake chamber. Thus, the refrigerant inside the refrigerant intake chamber absorbing heat from the refrigerant inside the refrigerant discharge chamber is thermally expanded, so a volume thereof is increased. Therefore, the compression efficiency is poor relative to the volume of the refrigerant which is sucked into the compression chamber.

In case of sucking or discharging the refrigerant into or from the compression chamber, an intake valve plate of the valve unit is opened or closed several thousand times per minute, so noise is generated due to mechanical friction. Thus, there have made continuous efforts to reduce the noise generated at the valve unit.

SUMMARY OF THE INVENTION

Accordingly, it is an aspect of the present invention to provide a suction muffler, which is designed to maximize an amount of a refrigerant sucked into a compression chamber and reduce suction noise to the minimum when the refrigerant is sucked into the compression chamber, and provides a compressor with the suction muffler and an apparatus having a refrigerant circulation circuit including the compressor.

Additional aspects and advantages of the invention will be set forth in part in the description which follows and, in part, will be obvious from the description, or may be learned by practice of the invention.

The foregoing and other aspects of the present invention are achieved by providing a suction muffler for compressors, including a refrigerant channel communicating at an inlet thereof with a suction pipe which guides a refrigerant to a compressor, and controllably communicating at an outlet thereof with a compression chamber in which the refrigerant is compressed, and an outer casing having a structure to convert a flowing motion of the refrigerant into a spiral flowing motion while the refrigerant flows from the suction pipe to the inlet.

The outer casing having the structure to convert the flowing motion of the refrigerant into the spiral flowing motion, surrounds a sidewall of the channel from a midsection to the inlet of the channel, with a refrigerant flowing space having a "U"-shaped longitudinal cross-section and defined between the sidewall of the channel and the outer casing, thus guiding the refrigerant from the suction pipe to around the sidewall of the channel.

Further, the outer casing also includes a guide pipe to guide the refrigerant from the suction pipe to around the sidewall of the channel. The guide pipe has a curved passage to reduce friction while the refrigerant flows through the guide pipe.

The outer casing downwardly extends from an inflection point of the "U"-shaped refrigerant flowing space to define an oil collecting space which collects oil from the refrigerant. The outer casing has an oil drain hole at a bottom of the oil collecting space so as to discharge collected oil from the oil collecting space.

The suction muffler also includes a resonator at a side of the outer casing to form a resonance space. The resonance space communicates with the refrigerant flowing space at a position around the sidewall of the refrigerant channel.

The foregoing and other aspects of the present invention are achieved by providing a suction muffler for compressors, including a refrigerant channel communicating at an inlet thereof with a suction pipe which guides a refrigerant to a compressor, and controllably communicating at an outlet thereof with a compression chamber in which the refrigerant is compressed, and at least one resonance chamber formed around the outlet of the refrigerant channel.

The resonance chamber comprises a first resonance chamber having a first communicating hole to communicate with the outlet of the refrigerant chamber, and second and third resonance chambers having second and third communicating holes, respectively, to communicate with the first resonance chamber.

The suction muffler further includes an outer casing surrounding a sidewall of the channel from a midsection to the inlet of the channel, with a refrigerant flowing space having a "U"-shaped longitudinal cross-section and defined between the sidewall of the channel and the outer casing, thus guiding the refrigerant from the suction pipe to around the sidewall of the channel. The suction muffler further includes a guide pipe to guide the refrigerant from the suction pipe to around the sidewall of the channel. The guide pipe has a curved passage to reduce friction while the refrigerant flows through the guide pipe.

The foregoing and other aspects of the present invention are achieved by providing a compressor, including a cylinder assembly having a sealed compression chamber to control an intake of a refrigerant into the compression chamber and a discharge of the refrigerant from the compression chamber after compressing the refrigerant, a suction muffler having a structure to convert a flowing motion of the refrigerant into a spiral flowing motion, before the refrigerant is sucked into the compression chamber, and a suction pipe to guide the refrigerant from an outside into the suction muffler.

The suction muffler, which converts the flowing motion of the refrigerant to the spiral flowing motion, includes a refrigerant channel communicating at an inlet thereof with the suction pipe and controllably communicating at an outlet thereof with the compression chamber, and an outer casing surrounding a sidewall of the channel from a midsection to the inlet of the channel, with a refrigerant flowing space having a "U"-shaped longitudinal cross-section and defined between the sidewall of the channel and the outer casing, thus guiding the refrigerant from the suction pipe to around the sidewall of the channel.

The outer casing further includes a guide pipe to guide the refrigerant from the suction pipe to around the sidewall of the channel, the guide pipe having a curved passage to reduce friction while the refrigerant flows through the guide pipe.

The outer casing downwardly extends from an inflection point of the "U"-shaped refrigerant flowing space to define an oil collecting space which collects oil from the refrigerant. The outer casing has an oil drain hole at a bottom of the oil collecting space so as to discharge collected oil from the oil collecting space.

The suction muffler further includes a resonator at a side of the outer casing to form a resonance space, the resonance space communicating with the refrigerant flowing space at a position around the sidewall of the refrigerant channel.

The foregoing and other aspects of the present invention are achieved by providing a compressor, including a cylinder assembly, a suction muffler, and a suction pipe. The cylinder assembly has a sealed compression chamber to control an intake of a refrigerant into the compression chamber and a discharge of the refrigerant from the compression chamber after compressing the refrigerant. The suction muffler has a refrigerant channel having an inlet through which the refrigerant from an outside flows into the channel and an outlet controllably communicating with the compression chamber, and at least one resonance chamber formed around the outlet of the refrigerant channel. The suction pipe guides the refrigerant from the outside into the suction muffler.

The resonance chamber comprises a first resonance chamber having a first communicating hole to communicate with the outlet of the refrigerant chamber, and second and third resonance chambers having second and third communicating holes, respectively, to communicate with the first resonance chamber.

The suction muffler further includes an outer casing surrounding a sidewall of the channel from a midsection to the inlet of the channel, with a refrigerant flowing space having a "U"-shaped longitudinal cross-section and defined between the sidewall of the channel and the outer casing, thus guiding the refrigerant from the suction pipe to around the sidewall of the channel. The outer casing further includes a guide pipe to guide the refrigerant from the suction pipe to around the sidewall of the channel, the guide pipe having a curved passage to reduce friction while the refrigerant flows through the guide pipe.

The foregoing and other aspects of the present invention are achieved by providing a compressor, including a cylinder block, a cylinder head, a valve unit, a suction muffler, a suction pipe, and an insulating space. The cylinder block has a compression chamber. The cylinder head seals the compression chamber, and is partitioned into a refrigerant intake chamber and a refrigerant discharge chamber by a partition wall. The valve unit is provided between the compression chamber and the cylinder head to control a flow of a refrigerant. The suction muffler reduces suction noise when the refrigerant is sucked into the compression chamber. The suction pipe guides the refrigerant from an outside into the suction muffler. The insulating space prevents a heat transfer between the refrigerant inside the refrigerant intake chamber and the refrigerant inside the refrigerant discharge chamber.

The suction muffler includes a head inserted into the refrigerant intake chamber, and a refrigerant channel having an outlet formed at a predetermined position inside the head and an inlet communicating with the suction pipe, and the insulating space is defined between the partition wall and the head.

Further, the insulating space is formed at the partition wall and/or the head.

The suction muffler further includes at least one resonance chamber which is defined around the outlet of the refrigerant channel inside the head. The resonance chamber comprises a first resonance chamber having a first communicating hole to communicate with the outlet of the refrigerant channel, and second and third resonance chambers having second and third communicating holes, respectively, to communicate with the first resonance chamber.

The suction muffler further includes an outer casing surrounding a sidewall of the channel from a midsection to the inlet of the channel, with a refrigerant flowing space having a "U"-shaped longitudinal cross-section and defined between the sidewall of the channel and the outer casing, thus guiding the refrigerant from the suction pipe to around the sidewall of the channel. The outer casing further includes a guide pipe to guide the refrigerant from the suction pipe to around the sidewall of the channel, the guide pipe having a curved passage to reduce friction while the refrigerant flows through the guide pipe.

Further, the foregoing and other aspects of the present invention are achieved by providing an apparatus having a refrigerant circulation circuit including the compressor.

BRIEF DESCRIPTION OF THE DRAWINGS

These and other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
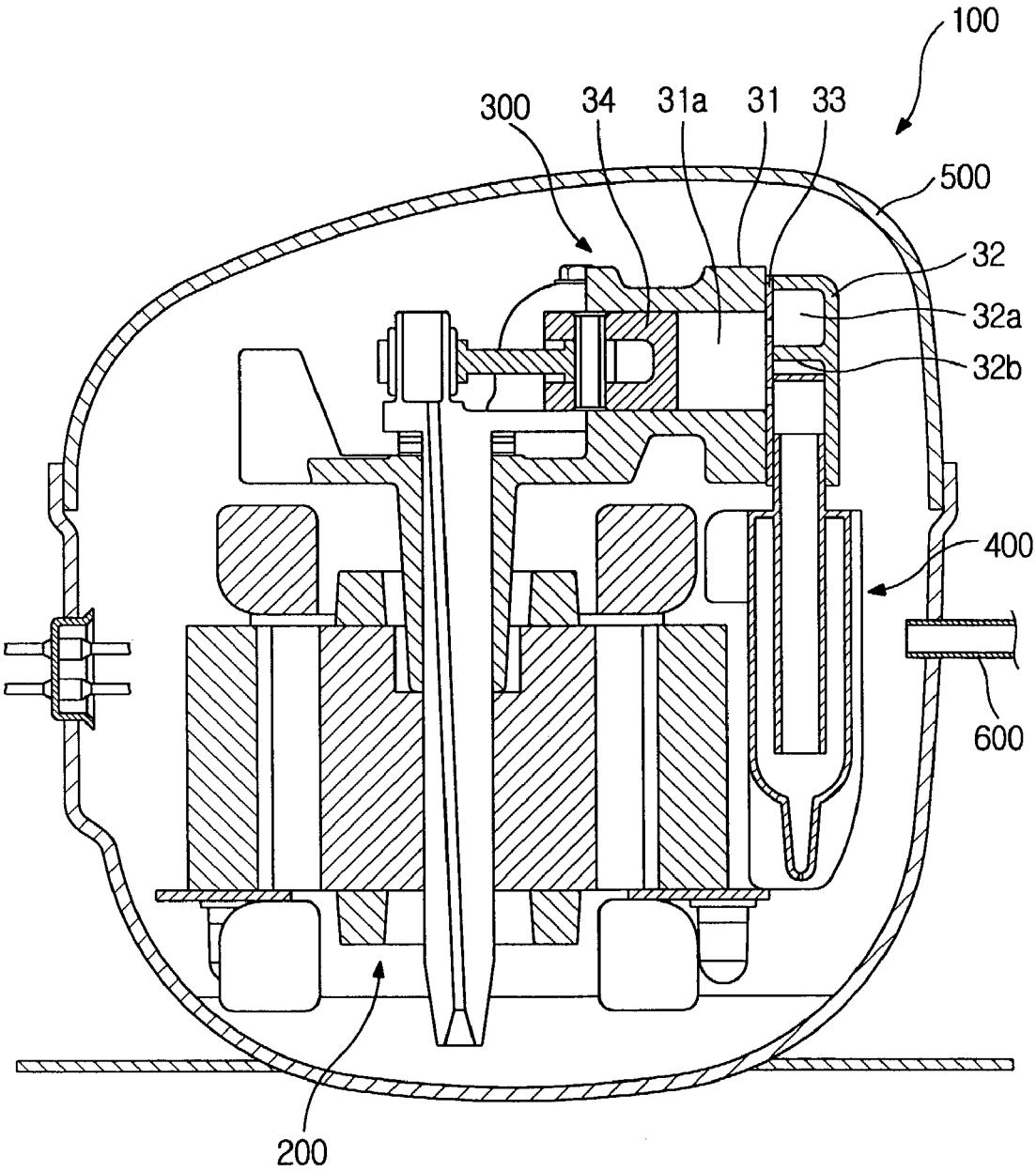
FIG. 1 is a side sectional view of a compressor, according to an embodiment of the present invention.

Reference will now be made in detail to the present preferred embodiments of the present invention, examples of which are illustrated in the accompanying drawings, wherein like reference numerals refer to like elements throughout.

Figure 2:
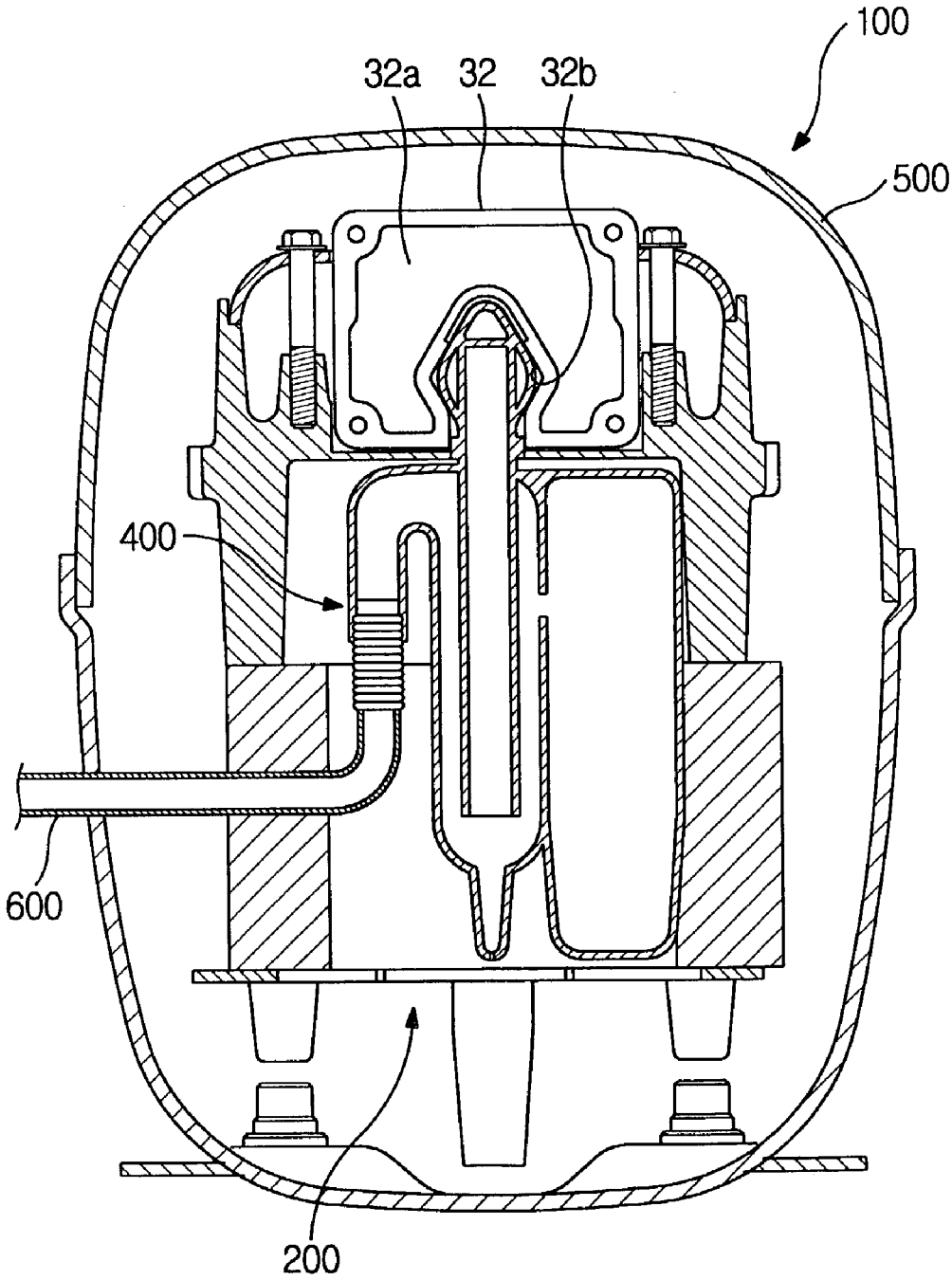
FIG. 2 is a front sectional view of the compressor of FIG. 1.

FIG. 1 is a side sectional view of a compressor, according to an embodiment of the present invention. FIG. 2 is a front sectional view of the compressor of FIG. 1.

Referring to FIGS. 1 and 2, the compressor 100 according to an embodiment of the present invention includes a motor unit 200, a compressing unit 300, a suction muffler 400, a casing 500, a suction pipe 600, and an exhaust pipe (not shown). The motor unit 200 is provided at a lower portion of the compressor 100, and the compressing unit 300 is provided at a predetermined portion above the motor unit 200. The motor unit 200, the compressing unit 300, and the suction muffler 400 are hermetically sealed in the casing 500. The suction pipe 600 guides a refrigerant from an outside to the suction muffler 400. The refrigerant is discharged through the exhaust pipe after being compressed.

Further, the compressing unit 300 includes a cylinder assembly and a piston 34. The cylinder assembly has a cylinder block 31, a cylinder head 32, and a valve unit 33. The cylinder block 31 has a compression chamber 31*a* in which the refrigerant is compressed. The cylinder head 32 seals the compression chamber 31*a*, and is provided with a refrigerant discharge chamber 32*a* and a refrigerant intake chamber 32*b*. The valve unit 33 is arranged between the cylinder block 3 and the cylinder head 32, and is provided with an intake valve plate and a discharge valve plate to control an intake of the refrigerant into the compression chamber 31*a* and a discharge of the refrigerant from the compression chamber 31*a* after compressing the refrigerant. Further, the piston 34 reciprocates in the compression chamber 31*a* by an operation of the motor unit 200 to compress the refrigerant. The suction muffler 400 is inserted into the refrigerant intake chamber 32*b*, as illustrated in the drawings, and will be later described in detail.

Figure 3:
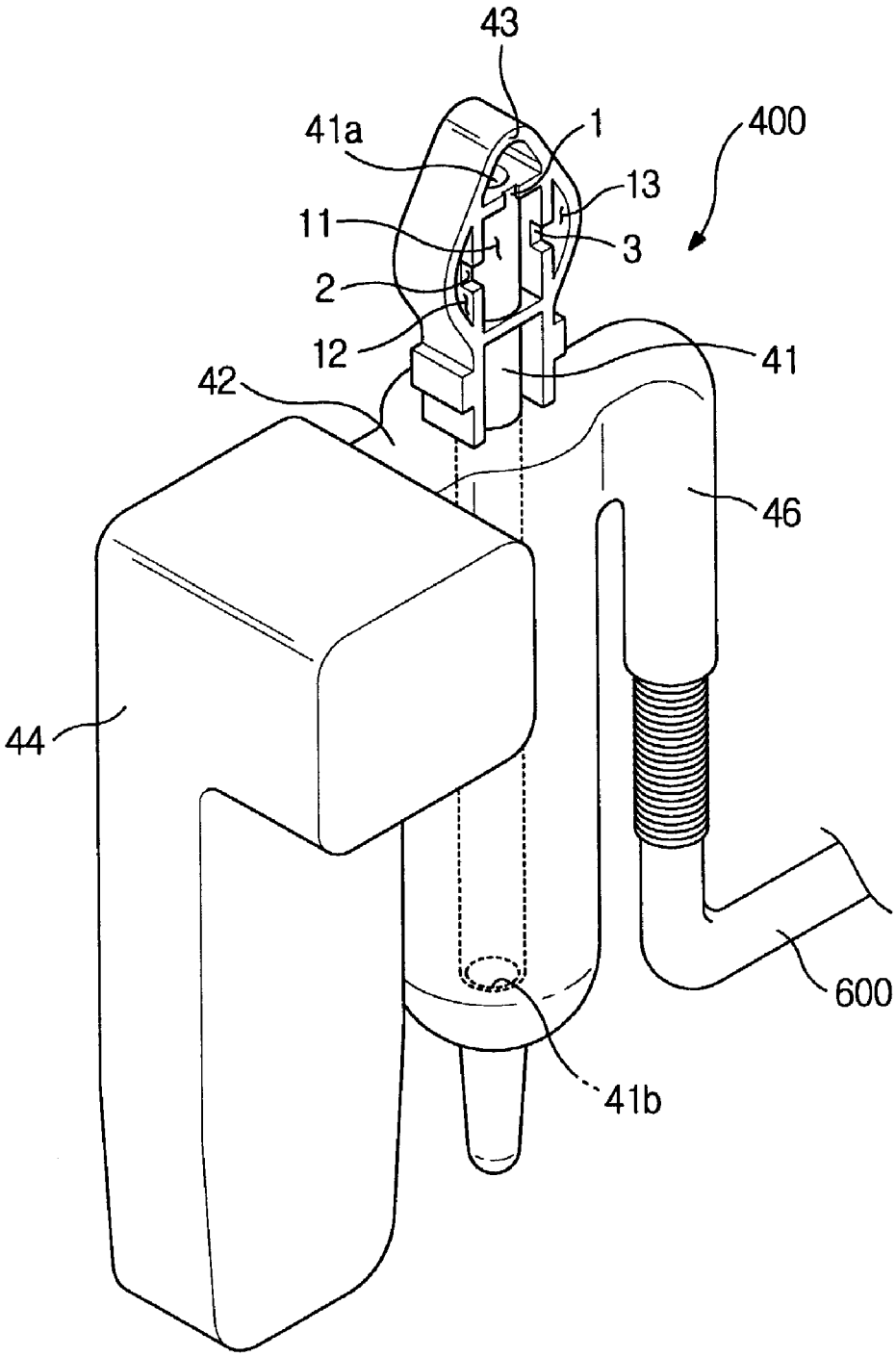
FIG. 3 is a perspective view of a suction muffler included in the compressor of FIG. 1.
Figure 4:
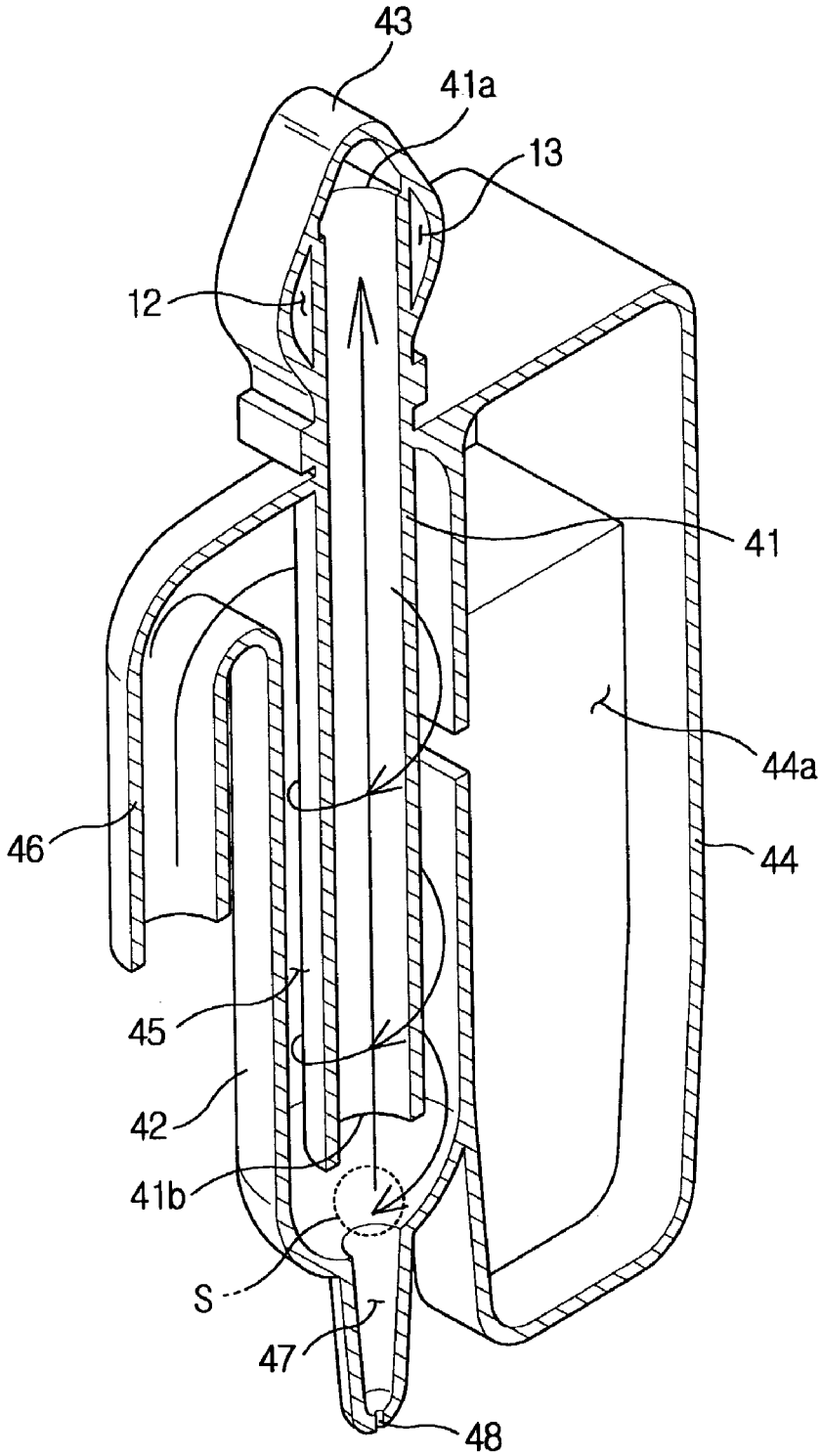
FIG. 4 is a sectional perspective view of the suction muffler of FIG. 3.

FIG. 3 is a perspective view of a suction muffler included in the compressor of FIG. 1. FIG. 4 is a sectional perspective view of the suction muffler of FIG. 3.

As illustrated in FIGS. 3 and 4, the suction muffler 400 according to an embodiment of the present invention includes a refrigerant channel 41, an outer casing 42, a head 43, and a resonator 44. The refrigerant channel 41 controllably communicates at an outlet 41*a* thereof with the compression chamber 31*a* in which the refrigerant is compressed and the valve unit 33, and communicates at an inlet 41*b* thereof with the suction pipe 600 which guides the refrigerant from an outside into the compressor 100. The outer casing 42 has a structure to convert a flowing motion of the refrigerant into a spiral flowing motion, while the refrigerant flows from the suction pipe 600 to the inlet 41*b*. The head 43 is inserted into the refrigerant intake chamber 32*b* of the cylinder head 32. First, second, and third resonance chambers 11, 12, and 13 are defined around the outlet 41*a* inside the head 43. The first resonance chamber 11 has a communicating hole 1 to communicate with the outlet 41*a*. The second and third resonance chambers 12 and 13 have communicating holes 2 and 3, respectively, to communicate with the first resonance chamber 11. The resonator 44 is provided at a side of the outer casing 42 to form a resonance space 44*a*, thus reducing flowing noise of the refrigerant.

In order to convert the flowing motion of the refrigerant into the spiral flowing motion, the outer casing 42 surrounds a sidewall of the refrigerant channel 41 from a midsection to the inlet 41*b* of the channel 41 so that a refrigerant flowing space 45 has a "U"-shaped longitudinal cross-section and is defined between the sidewall of the channel 41 and the outer casing 42. The outer casing 42 also includes a guide pipe 46 to guide the refrigerant from the suction pipe 600 to around the sidewall of the channel 41. The guide pipe 46 has a curved passage to reduce friction of the refrigerant while the refrigerant flows through the guide pipe 46. As illustrated in the drawings, the resonance space 44*a* communicates with the refrigerant flowing space 45 at a position around the sidewall of the refrigerant channel 41.

Further, a stay space S is defined between the inlet 41*b* of the channel 41 and an inflection point of the "U"-shaped refrigerant flowing space 45, thus allowing the refrigerant to stay in the stay space S as long as possible. The outer casing 42 downwardly extends from the inflection point of the "U"-shaped refrigerant flowing space 45 to define an oil collecting space 47 which collects oil from the refrigerant. The outer casing 42 has an oil drain hole 48 at a bottom of the oil collecting space 47 so as to discharge collected oil from the oil collecting space 47.

Figure 5:
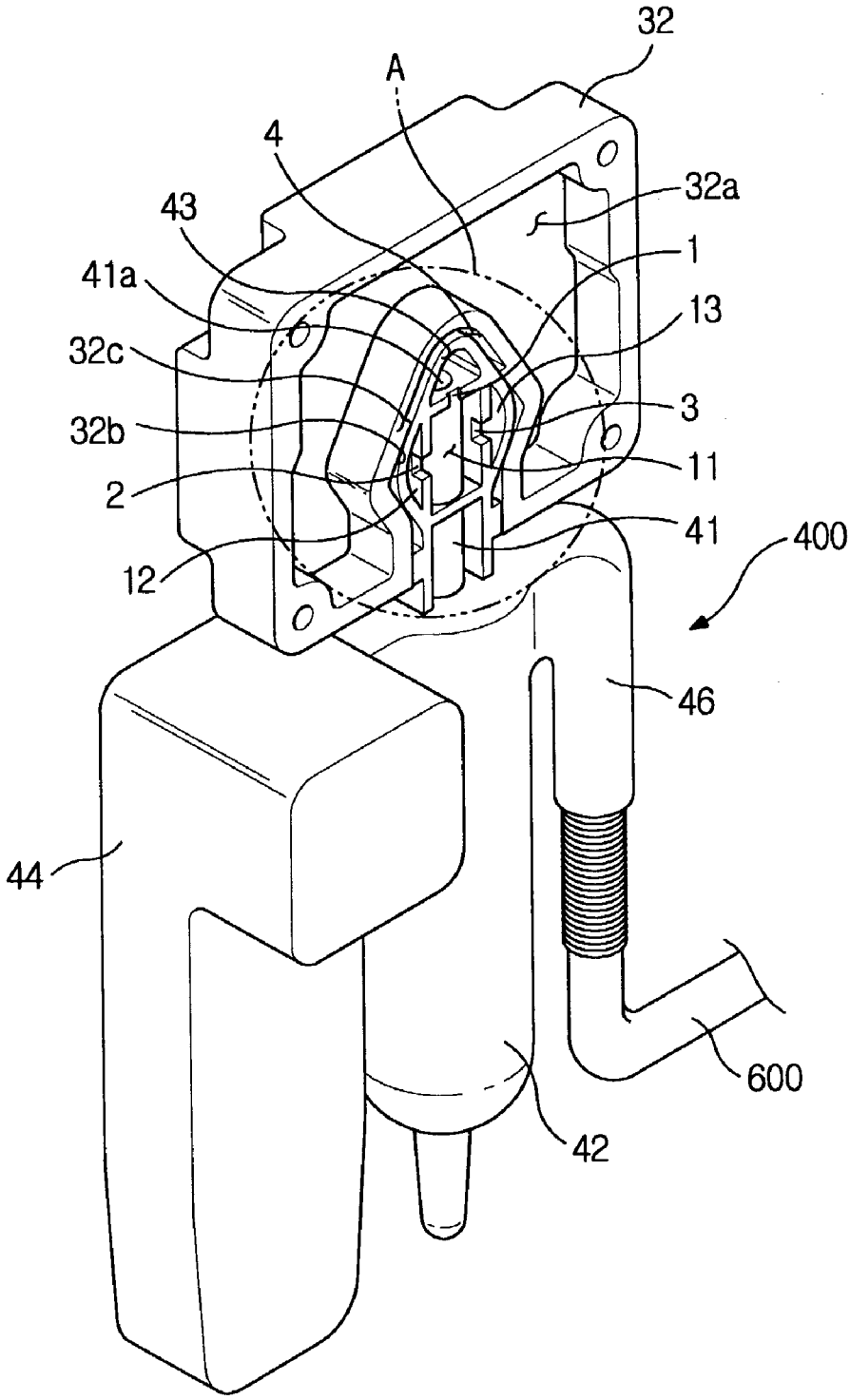
FIG. 5 is a perspective view illustrating the suction muffler of FIG. 3, in which the suction muffler is inserted into a cylinder head.
Figure 6:
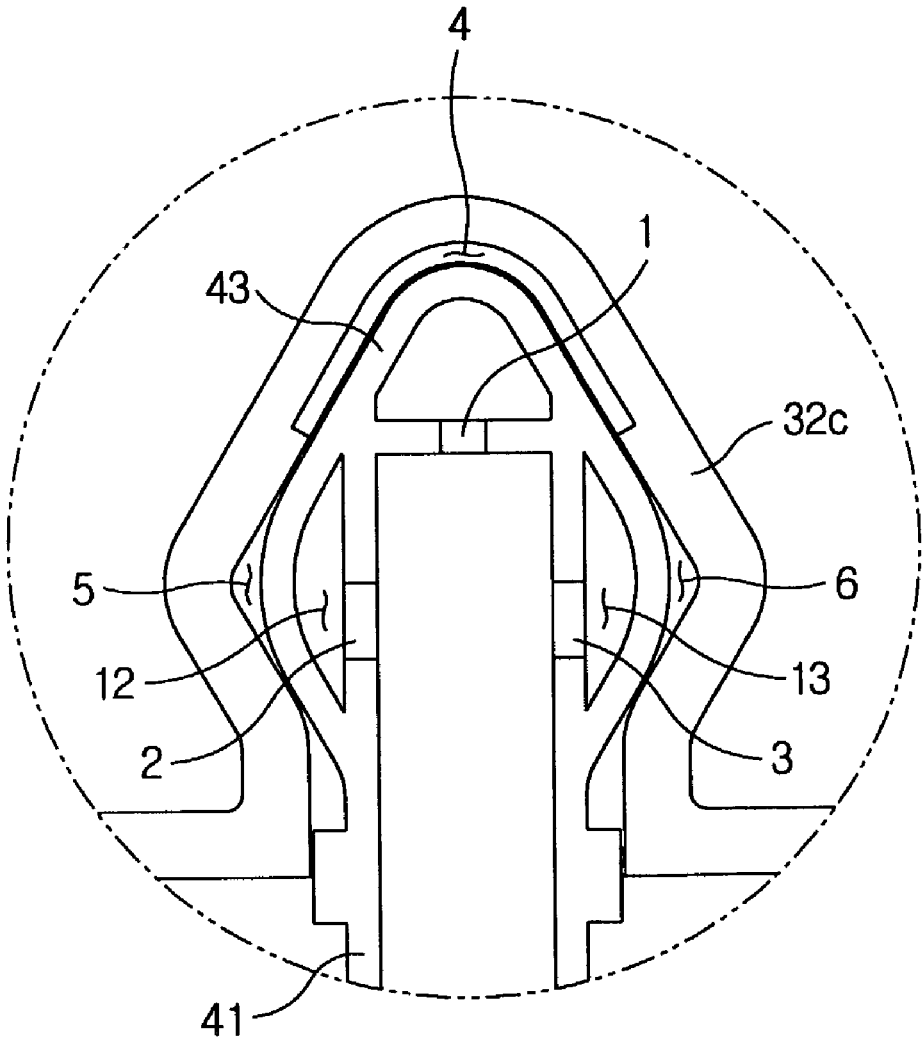
FIG. 6 is an enlarged elevational view of the part "At" encircled in FIG. 5.

FIG. 5 is a perspective view illustrating the suction muffler of FIG. 3, in which the suction muffler is inserted into a cylinder head. FIG. 6 is an enlarged sectional view of the part "A" encircled in FIG. 5.

Figure 7:
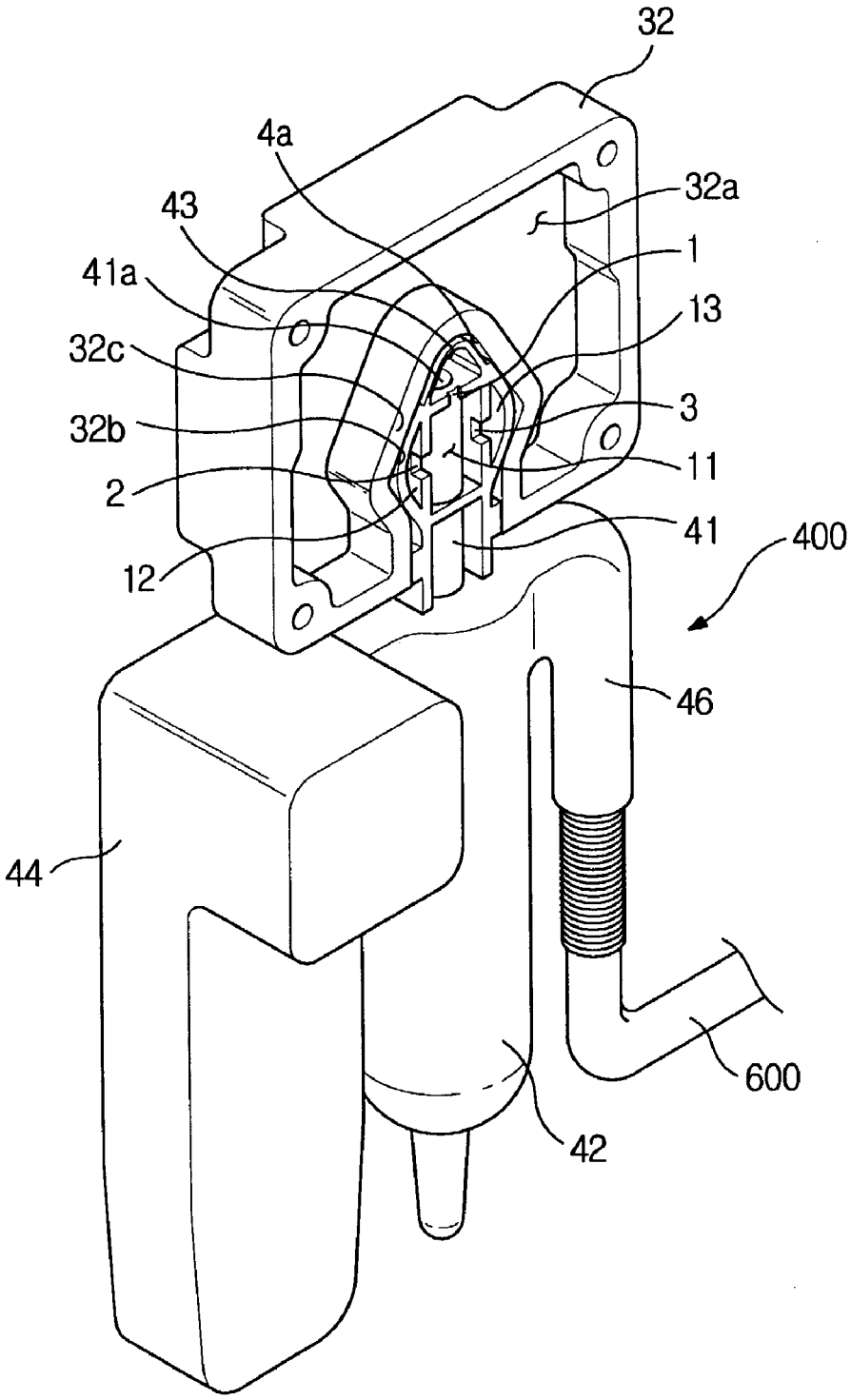
FIG. 7 is a perspective view of a suction muffler, according to another embodiment of the present invention.

Referring to FIGS. 5 and 6, the cylinder head 32 is partitioned into the refrigerant discharge chamber 32*a* and the refrigerant intake chamber 32*b* by a partition wall 32*c*. The head 43 of the suction muffler 400 is inserted into the refrigerant intake chamber 32*b*. In this case, as illustrated in FIG. 6, first, second, and third insulating spaces 4, 5, and 6 are defined between the partition wall 32*c* and the head 43. The insulating spaces 4, 5, and 6 function to prevent a heat transfer between the high-temperature refrigerant inside the refrigerant discharge chamber 32*a* and the refrigerant remaining in the head 43 just before being sucked into the compression chamber 31*a*. In this case, the first insulating space 4 is formed on the partition wall 32*c*, and the second and third insulating spaces 5 and 6 are defined between the partition wall 32*c* and the head 43. But, all the first, second, and third insulating spaces 4, 5, and 6 may be formed on the partition wall 32*c* or on the outer surface of the head 4. Or, all the first, second, and third insulating spaces 4, 5, and 6 may be formed on both the partition wall 32*c* and the head 4. Of course, in a manner similar to that illustrated in FIG. 6, all the first, second, and third insulating spaces 4, 5, and 6 may be defined between the partition wall 32*c* and the head 43 due to shapes of the partition wall 32*c* and the head 43. FIG. 7 illustrates an example where an insulating space 4*a* is formed on the outer surface of the head 43.

Figure 8:
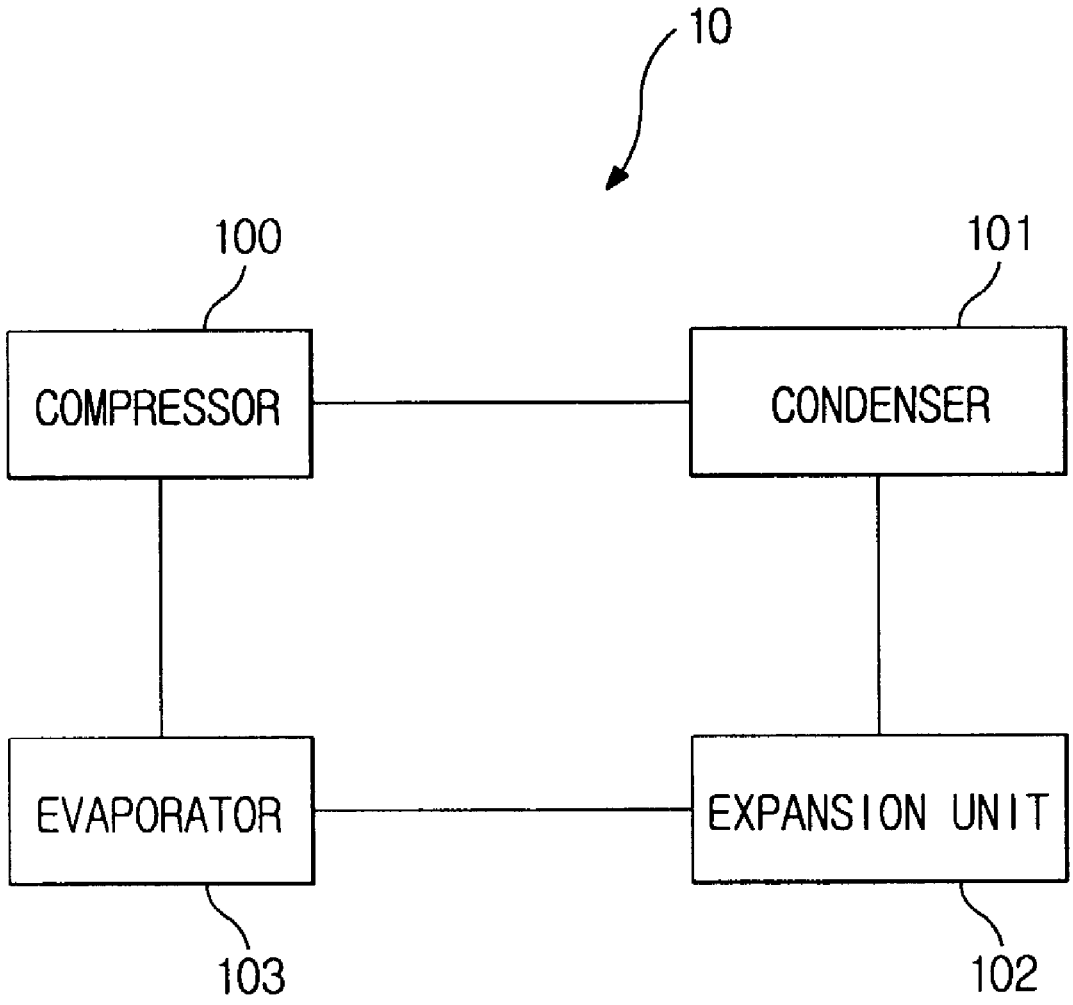
FIG. 8 is a block diagram illustrating a refrigerant circulation circuit having the compressor of FIG. 1.

FIG. 8 is a block diagram illustrating a refrigerant circulation circuit having the compressor of FIG. 1. Referring to FIG. 8, an apparatus having a refrigerant circulation circuit 10 includes the compressor 100, a condenser 101 to condense the refrigerant fed from the compressor 100, an expansion unit 102, such as an expansion valve or a capillary tube, to expand the refrigerant fed from the condenser 101, and an evaporator 103. The refrigerant expanded in the expansion unit 102 is fed into the evaporator 103 to be evaporated, thus absorbing heat from air around it.

The operation of the compressor 100 according to the present invention will be described in the following with reference to FIGS. 1 to 8.

First, when the compressor 100 is operated, the refrigerant is compressed in the compression chamber 31*a* by a reciprocating movement of the piston 34 so as to increase pressure and temperature of the refrigerant to a predetermined extent. At this time, a discharge valve of a discharge valve plate of the valve unit 33 is opened due to a difference in pressure. Thus, high discharge pressure of the refrigerant when the refrigerant is discharged from the compression chamber 31*a* is transmitted to the refrigerant discharge chamber 32*a* of the cylinder head 32 through the valve unit 33. The exhaust pressure transmitted to the refrigerant discharge chamber 32*a* is sequentially transmitted to a long passage which comprises the condenser 101, the expansion unit 102, and the evaporator 103 through the exhaust pipe which guides the refrigerant to the outside of the compressor 100. Such exhaust pressure allows the refrigerant to flow from the suction pipe 600 to the guide pipe 46 of the suction muffler 400.

The guide pipe 46 guides the refrigerant to around the midsection of the sidewall of the refrigerant channel 41. In this case, since the guide pipe 46 having the curved passage minimizes friction of the refrigerant while the refrigerant flows through the guide pipe 46, the refrigerant flows to around the midsection of the sidewall of the channel 41 at a high speed.

Thereafter, the refrigerant flows downward from the midsection of the sidewall of the channel 41 to the inlet 41*b* of the channel 41 along the refrigerant flowing space 45. The refrigerant, flowing into the refrigerant flowing space 45 at a high speed by the guide pipe 46, spirally flows along the refrigerant flowing space 45 defined between an inner surface of the outer casing 42 and the sidewall of the channel 41. In this case, a swirling speed of the refrigerant is high, but it takes much time for the refrigerant to flow from the midsection of the sidewall of the channel 41 to the inlet 41*b* of the channel 41. Thus, the refrigerant flowing speed is slow at the stay space S which is adjacent to the inlet 41*b* of the channel 41, so the refrigerant stays in the stay space S for a lengthy period of time due to a slow dispersing speed thereof. Thus, when it is required to perform a compression stroke after the exhaust stroke, the refrigerant staying in the stay space S for a lengthy period of time passes through the channel 41 and the outlet 41*a* of the channel 41, and then is sucked into the compression chamber 31*a* by a sucking force of the compression chamber 31*a* generated when the piston 34 is pulled out. Since the refrigerant stays in the stay space S, the refrigerant has large density relative to a volume thereof, so the refrigerant having a large density is sucked into the compression chamber 31*a*. In an operation of the compressor 100, the compression stroke is performed in the compression chamber 31*a* several thousand times per minute and a single compression stroke is finished within a very short period of time, so that the above-mentioned suction of the large density refrigerant into the compression chamber 31*a* enhances the compression efficiency of the compressor 100.

Further, since the refrigerant stays in the stay space S and a dispersing speed of the refrigerant is slow, most of the refrigerant is sucked into the compression chamber 31*a* without flowing into the resonance space 44*a* defined in the resonator 44 which is provided at a side of the outer casing 42, at the suction stroke. Thus, an amount of the refrigerant flowing into the resonance space 44*a* is small, so the resonator 44 effectively functions to resonate.

Further, at the suction stroke, the refrigerant fed into the compression chamber 31*a* after passing through the channel 41 and the refrigerant intake chamber 32*b* has a relatively low temperature, in comparison with the refrigerant discharged from the compression chamber 31*a*. The sucked refrigerant is separated from the discharged refrigerant by the head 43 and the partition wall 32*c* which partitions the cylinder head 32 into the refrigerant intake chamber 32*b* and the refrigerant discharge chamber 32*a*, so a heat transfer may occur between the sucked refrigerant and the discharged refrigerant through the head 43 and the partition wall 32*c*. However, as illustrated in FIGS. 5 to 7, the insulating spaces 4, 5, and 6 are defined between the partition wall 32*c* and the head 43, thus considerably reducing the heat transfer between the sucked refrigerant and the discharged refrigerant through the head 43 and the partition wall 32*c*. As a result, the heat transfer between the sucked refrigerant and the discharged refrigerant is prevented, thus reducing a thermal expansion of the refrigerant sucked into the compression chamber 31*a*, therefore increasing an amount of the refrigerant sucked into the compression chamber 31*a* relative to a volume thereof.

In order to smoothly compress the refrigerant in the compression chamber 31*a*, oil is supplied to the compression chamber 31*a*. While the refrigerant is compressed, the oil is introduced into the refrigerant. By the oil laden in the refrigerant, the compression efficiency of the compressor 100 becomes poor. Thus, according to the present invention, while the refrigerant passing through the guide pipe 46 of the suction muffler 400 flows through the refrigerant flowing space and the inlet 41*b* of the channel 41 to the outlet 41*a* of the channel 41, the oil laden in the refrigerant flows down along an inner surface of the outer casing 42 and outer and inner surfaces of the sidewall of the channel 41. At this time, the oil is collected into the oil collecting space 47 which is provided below the stay space S, and is discharged through the oil drain hole 48, thus reducing an amount of the oil laden in the refrigerant flowing along the passage of the refrigerant circulation circuit 10.

Further, the compression strokes are performed several thousand times per minute, by the reciprocating movement of the piston 34, so the intake valve of the intake valve plate of the valve unit 33 is opened and closed several thousand times per minute. At this time, mechanical friction noise is generated due to the opening and closing of the intake valve. Such mechanical friction noise is reduced by the first, second, and third resonance chambers 11, 12, and 13 which are defined around the outlet 41*a* of the channel 41 inside the head 43 of the suction muffler 400. In this case, when the communicating hole 1 at which the first resonance chamber 11 communicates with the outlet 41*a*, and the communicating holes 2 and 3 at which the second and third resonance chambers 12 and 13 communicate with the first resonance chamber 11 are adjusted in their sizes, noise of a given frequency band is reduced. The communicating holes 1, 2, and 3 each are designed to have a size which is preset at a manufacturing process. The suction muffler 400 is manufactured, based on the design of the communicating holes 1, 2, and 3.

As apparent from the above description, the present invention provides a compressor, which is designed to maximize a density of a refrigerant sucked into a compression chamber, thus allowing the maximum amount of the refrigerant to be compressed. Further, the present invention provides a compressor, which is designed to reduce an amount of oil laden in the refrigerant flowing along a passage of a refrigerant circulation circuit, thus increasing a compression efficiency of the compressor. Therefore, a heating and cooling efficiency of a refrigerant circulation circuit having the compressor is also increased.

Further, the present invention provides a compressor, which is designed to considerably reduce mechanical friction noise of an intake valve generated during a suction stroke, and which is designed to effectively reduce noise of a given frequency band.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A suction muffler for compressors, comprising:

a refrigerant channel communicating at an inlet thereof with a suction pipe which guides a refrigerant to a compressor, and communicating at an outlet thereof with a compression chamber in which the refrigerant is compressed; and an outer casing having a structure to convert a flowing motion of the refrigerant into a spiral flowing motion while the refrigerant flows from the suction pipe to the inlet, wherein the outer casing having the structure to convert the flowing motion of the refrigerant into the spiral flowing motion surrounds a sidewall of the channel, with a refrigerant flowing space having a "U"-shaped longitudinal cross-section defined between the sidewall of the channel and the outer casing, thus guiding the refrigerant from the suction pipe to around the sidewall of the channel.

2. The suction muffler according to claim 1, wherein the outer casing further comprises a guide pipe to guide the refrigerant from the suction pipe to around the sidewall of the channel, the guide pipe having a curved passage to reduce friction while the refrigerant flows through the guide pipe.

3. The suction muffler according to claim 1, wherein the outer casing extends to an inflection point of the "U"-shaped refrigerant flowing space to define an oil collecting space which collects oil from the refrigerant.

4. The suction muffler according to claim 3, wherein the outer casing has an oil drain hole at a bottom of the oil collecting space so as to discharge collected oil from the oil collecting space.

5. The suction muffler according to claim 1, further comprising a resonator at a side of the outer casing to form a resonance space, the resonance space communicating with the refrigerant flowing space at a position around the sidewall of the refrigerant channel.

6. A compressor comprising:

a cylinder assembly having a sealed compression chamber to suck a refrigerant into the compression chamber and a discharge of the refrigerant from the compression chamber after compressing the refrigerant;

a suction muffler having a structure to convert a flowing motion of the refrigerant into a spiral flowing motion, before the refrigerant is sucked into the compression chamber; and a suction pipe to guide the refrigerant from an outside into the suction muffler, wherein the suction muffler to convert the flowing motion of the refrigerant to the spiral flowing motion, comprises:

a refrigerant channel communicating at an inlet thereof with the suction pipe, and controllably communicating at an outlet thereof with the compression chamber, and an outer casing surrounding a sidewall of the channel from a midsection to the inlet of the channel, with a refrigerant flowing space having a "U"-shaped longitudinal cross-section and defined between the sidewall of the channel and the outer casing, thus guiding the refrigerant from the suction pipe to around the sidewall of the channel.

7. The compressor according to claim 6, wherein the outer casing further comprises a guide pipe guide the refrigerant from the suction pipe to around the sidewall of the channel, the guide pipe having a curved passage to reduce friction while the refrigerant flows through the guide pipe.

8. The compressor according to claim 6, wherein the outer casing downwardly extends from an inflection point of the "U"-shaped refrigerant flowing space to define an oil collecting space which collects oil from the refrigerant.

9. The compressor according to claim 8, wherein the outer casing has an oil drain hole at a bottom of the oil collecting space so as to discharge collected oil from the oil collecting space.

10. The compressor according to claim 6, wherein the suction muffler further comprises a resonator at a side of the outer casing to form a resonance space, the resonance space communicating with the refrigerant flowing space at a position around the sidewall of the refrigerant channel.

11. An apparatus having a refrigerant circulation circuit, the refrigerant circulation circuit comprising:

a compressor according to claim 6 for compressing a low pressure refrigerant to a high pressure refrigerant;

a condenser for condensing the refrigerant fed from the compressor;

an expansion unit for expanding the refrigerant fed from the condenser;

an evaporator for evaporating the refrigerant fed from the expansion unit and absorbing heat from air around it.

* * * * *